US008763799B2

(12) United States Patent
Haidar

(10) Patent No.: US 8,763,799 B2
(45) Date of Patent: Jul. 1, 2014

(54) HOOKAH TOBACCO CONTAINER

(76) Inventor: Raed Haidar, Washington, DC (US)

( * ) Notice: Subject to any disclaimer, the term of this patent is extended or adjusted under 35 U.S.C. 154(b) by 0 days.

(21) Appl. No.: 13/596,717

(22) Filed: Aug. 28, 2012

(65) Prior Publication Data

US 2014/0061073 A1 Mar. 6, 2014

(51) Int. Cl.
*A24F 25/00* (2006.01)
*A24F 23/00* (2006.01)

(52) U.S. Cl.
USPC ..... 206/242; 131/173

(58) Field of Classification Search
USPC ..... 131/173, 195, 231, 329, 330, 174–178; 206/242
See application file for complete search history.

(56) References Cited

U.S. PATENT DOCUMENTS

| | | | | | |
|---|---|---|---|---|---|
| 3,209,765 | A * | 10/1965 | Shih | 131/173 |
| 3,703,179 | A * | 11/1972 | Nubla | 131/173 |
| 3,889,690 | A * | 6/1975 | Guarnieri | 131/185 |
| 4,029,109 | A * | 6/1977 | Kahler | 131/173 |
| 4,165,753 | A * | 8/1979 | Stryker | 131/173 |
| 5,738,116 | A * | 4/1998 | Truelove | 131/173 |
| 6,418,936 | B1 * | 7/2002 | Lee | 131/178 |
| 2011/0308537 | A1 * | 12/2011 | Khoury et al. | 131/174 |

* cited by examiner

*Primary Examiner* — Bryon Gehman
(74) *Attorney, Agent, or Firm* — James M Smedley LLC; James Michael Smedley, Esq.

(57) ABSTRACT

The present invention generally relates to a container for tobacco for use in hookahs or other smoking apparatuses. Specifically, this invention relates to a hookah tobacco container that is configured such that liquids contained in the tobacco or stored with the tobacco are allowed to be separated and stored away from the tobacco. Embodiments of the present invention include a container comprising a chamber for the retention of tobacco and one or more separation areas for the separation of liquids from the tobacco.

17 Claims, 4 Drawing Sheets

HOOKAH TOBACCO CONTAINER

FIELD OF THE INVENTION

The present invention generally relates to a container for tobacco for use in hookahs or other smoking apparatuses. Specifically, this invention relates to a hookah tobacco container that is configured such that liquids contained in the tobacco or stored with the tobacco are allowed to be separated and stored away from the tobacco. Embodiments of the present invention include a container comprising a chamber for the retention of tobacco and one or more separation areas for the separation of liquids from the tobacco.

BACKGROUND OF THE INVENTION

Hookahs and other smoking apparatuses have been used for centuries. Regardless of the type of device, each of these smoking apparatuses require a source of partially dried tobacco. The tobacco is occasionally flavored with oils or other substances to enhance the desirability and taste of the inhalable smoke.

One frequent issue users of these smoking apparatuses have is that storing tobacco can be a complex task. On one hand, tobacco left out in the open will dry out and become stale, brittle or otherwise inappropriate for use in a smoking apparatus. On the other hand, tobacco stored in liquids, high-humidity or the like, the tobacco can become hard to ignite and may become prone to hazardous contaminations, such as mold, bacteria growth and insects (e.g., tobacco beetles).

Therefore, proper storage and maintenance of the tobacco is crucial. In some scenarios, tobacco is stored in a humidor or other area where humidity can be monitored and controlled in a sealed environment (e.g., box, room, table). However, humidors are generally not portable and not adequate or cost effective for the consumer sale and purchase of tobacco.

Storing tobacco in containers, generally sealed from the external environment, has been a favored approach. However, these containers are generally cylindrical containers with the tobacco stored inside. Over extended periods of time, the liquids and natural oils in the tobacco tend to settle at the bottom of the container. This creates the situation where the tobacco at the top of the container becomes dry and brittle, while the tobacco at the bottom of the container becomes soggy and prone to afflictions previously mentioned (e.g., mold, bacteria, insects, rot).

Therefore, there is a need in the art for a tobacco container that allows for storage of tobacco within the container while protecting the tobacco from the liquids and natural oils stored with the tobacco. These and other features and advantages of the present invention will be explained and will become obvious to one skilled in the art through the summary of the invention that follows.

SUMMARY OF THE INVENTION

Accordingly, embodiments of the present invention are directed to providing a tobacco container that allows for storage of tobacco within the container while protecting the tobacco from the liquids and natural oils stored with the tobacco.

According to an embodiment of the present invention, a hookah tobacco container includes: a container body comprising a walled area and a bottom portion connected in a manner forming a hollow cavity for the receipt of tobacco, wherein said bottom portion comprises one or more liquid retention areas, wherein said one or more liquid retention areas are configured to store liquids.

According to an embodiment of the present invention, the liquid retention areas are further include a filtering means.

According to an embodiment of the present invention, the filtering means prevents tobacco from entering said one or more liquid retention areas.

According to an embodiment of the present invention, the filtering means comprises a porous filter.

According to an embodiment of the present invention, the filtering means comprises a screen.

According to an embodiment of the present invention, the hookah tobacco container includes a top.

According to an embodiment of the present invention, the top is configured to be received upon the container body such that the hollow cavity is sealed.

According to an embodiment of the present invention, the liquid retention areas are comprised of generally circular depressions in the bottom portion.

According to an embodiment of the present invention, the liquid retention areas further provide stabilization for the tobacco container.

The foregoing summary of the present invention with the preferred embodiments should not be construed to limit the scope of the invention. It should be understood and obvious to one skilled in the art that the embodiments of the invention thus described may be further modified without departing from the spirit and scope of the invention.

DETAILED SPECIFICATION

Figure 1:
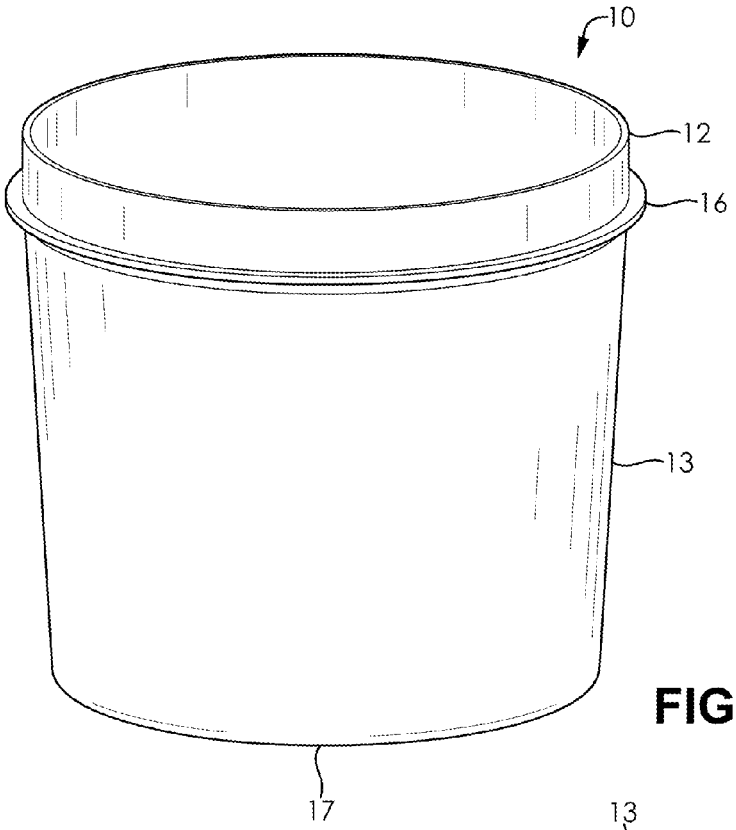
FIG. 1 is a side view of a hookah tobacco container in accordance with an embodiment of the present invention.

The present invention generally relates to a container for tobacco for use in hookahs or other smoking apparatuses. Specifically, this invention relates to a hookah tobacco container that is configured such that liquids contained in the tobacco or stored with the tobacco are allowed to be separated and stored away from the tobacco. Embodiments of the present invention include a container comprising a chamber for the retention of tobacco and one or more separation areas for the separation of liquids from the tobacco.

According to an embodiment of the present invention, a hookah tobacco container may be comprised of a walled area with a bottom portion attached to the walled area in order to form a hollow cavity appropriate for the receipt of tobacco or other smoking materials or fuels, such as those utilized with the operation of hookahs or other smoking devices (e.g., tobacco pipes). The bottom portion is formed with one or more liquid retention areas configured to receive moisture or other liquids that are present in the tobacco or other smoking materials.

According to an embodiment of the present invention, the liquid retention areas may be comprised of indents formed in the bottom portion of the tobacco container. Each indent is configured to maintain a portion of the liquids stored with or contained on the tobacco placed in the container. Over time, the liquids will drain off the tobacco and be stored in the liquid retention areas. This allows the liquids to be stored separately from the tobacco, while still being stored in the same container as the tobacco.

In certain embodiments, only one liquid retention area is provided. In other embodiments, numerous liquid retention areas are provided. The size and shape of liquid retention areas may be varied depending on the type of tobacco to be stored and the amount of liquid to be stored with the tobacco.

In certain configurations, the liquid retention areas may be configured in a pattern that extends from the bottom of the hookah tobacco container in a manner that provides traction and stability to the hookah tobacco container. Further, patterns of the liquid retention areas may be mated with patterns on a top of the hookah tobacco container to allow for convenient stacked storage of the hookah tobacco containers on top of each other. In certain embodiments, the mating of the hookah tobacco containers may be effected through a locking that occurs between the liquid retention means of the bottom portion of one hookah tobacco container and the pattern on the top of another hookah tobacco container.

When the tobacco is to be used, the container may be shaken or otherwise manipulated such that the liquids are returned to the tobacco. This is especially useful when the tobacco is stored with flavored oils or other liquid ingredients intended to enhance the flavor of the tobacco. In this manner, the tobacco is stored in an appropriately dry manner, keeping it free from the ravages of being stored in a liquid while still allowing the retention of the liquids in the same container.

According to an embodiment of the present invention, the liquid retention areas may be further enhanced by providing a filtering means over each liquid retention area. The filtering means may include, but are not limited to, screens, filter paper, filter material, mesh screens, grids, fabric and other porous materials that would allow for liquids to pass through but prevent tobacco from entering the liquid retention areas. In this manner, the liquid retention areas may be closed off from the tobacco, allowing the liquid and tobacco to be safely stored separately, while still being retained in the same container. One of ordinary skill in the art would appreciate that there are numerous types of filtering means that could be utilized with embodiments of the present invention, and embodiments of the present invention are contemplated for use with any type of filtering means.

According to an embodiment of the present invention, the container may be further comprised of a top. The top is configured to be received on the top opening of the tobacco container. In certain embodiments, the top may be configured to be removed only once (e.g., peel top). In other embodiments, the top may be configured to be removed and reapplied to the tobacco container multiple times (e.g., screw top, snap top).

According to an embodiment of the present invention, the top is configured to seal the tobacco container from the outside elements while also working to retain the liquids and humidity inside the container. In this manner, the top works with the tobacco container to extend the freshness of the tobacco for extended periods of time.

Exemplary Embodiments

Figure 2:
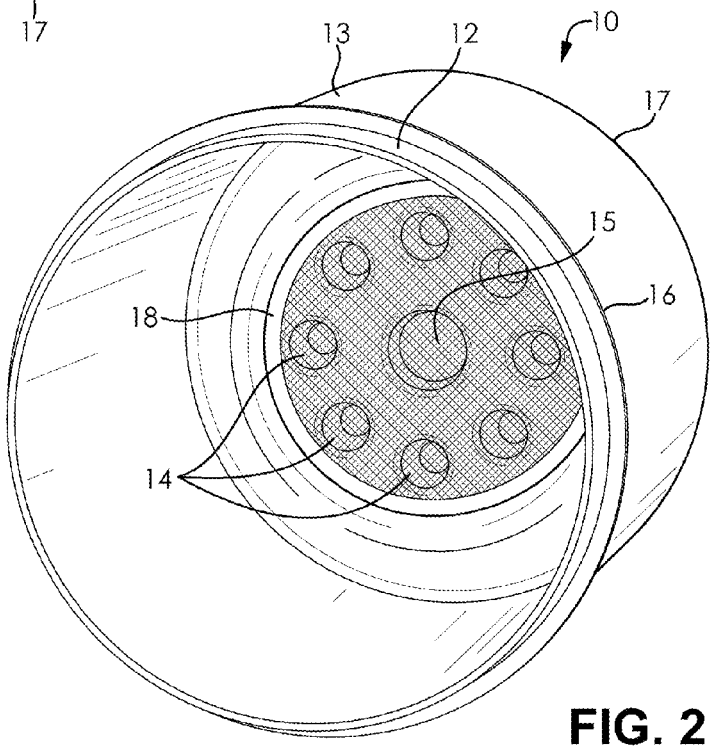
FIG. 2 is a perspective view of a hookah tobacco container in accordance with an embodiment of the present invention.
Figure 3:
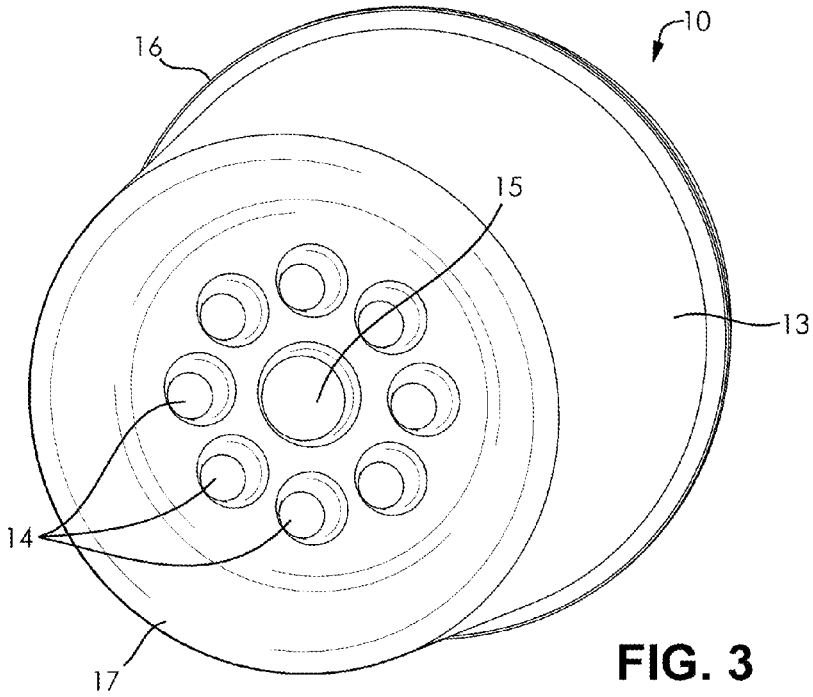
FIG. 3 is a rear perspective view of a hookah tobacco container in accordance with an embodiment of the present invention.
Figure 4:
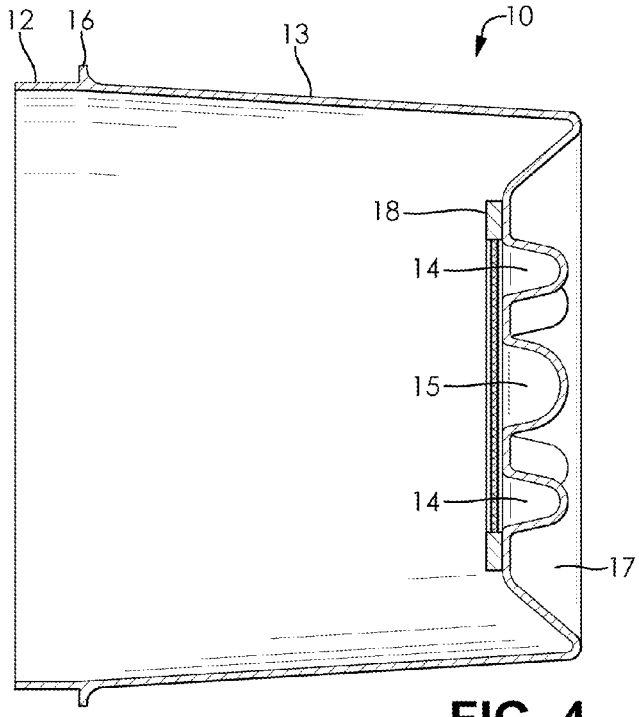
FIG. 4 is a side view of a hookah tobacco container in accordance with an embodiment of the present invention.
Figure 5:
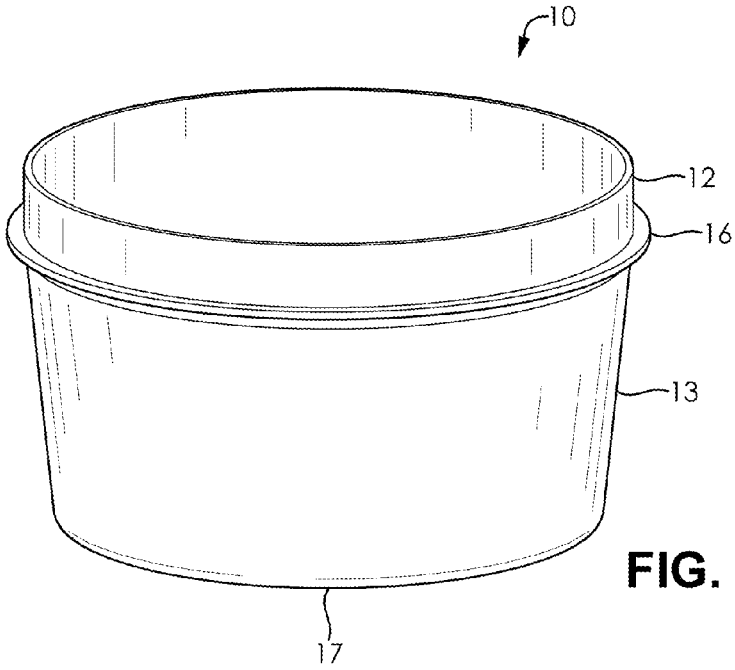
FIG. 5 is a side perspective view of a hookah tobacco container in accordance with an embodiment of the present invention.
Figure 6:
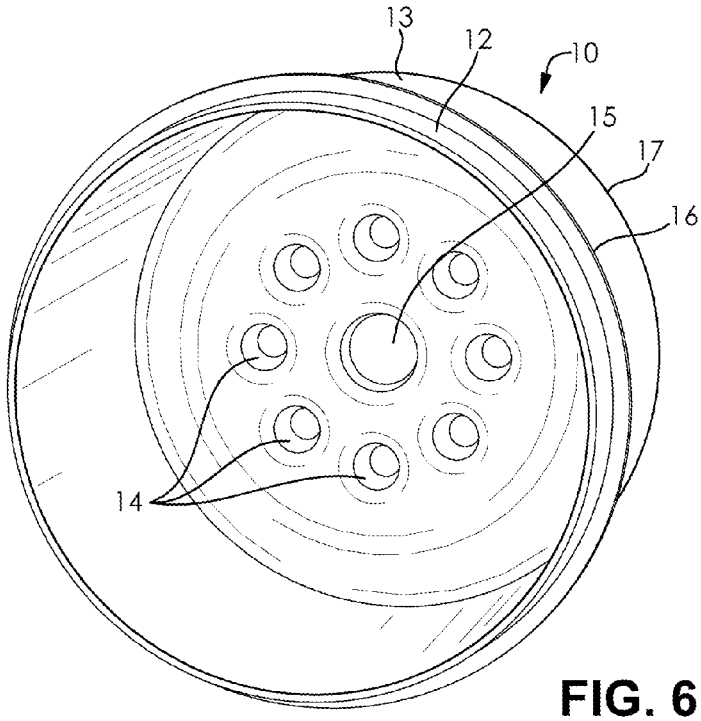
FIG. 6 is a top perspective view of a hookah tobacco container in accordance with an embodiment of the present invention.
Figure 7:
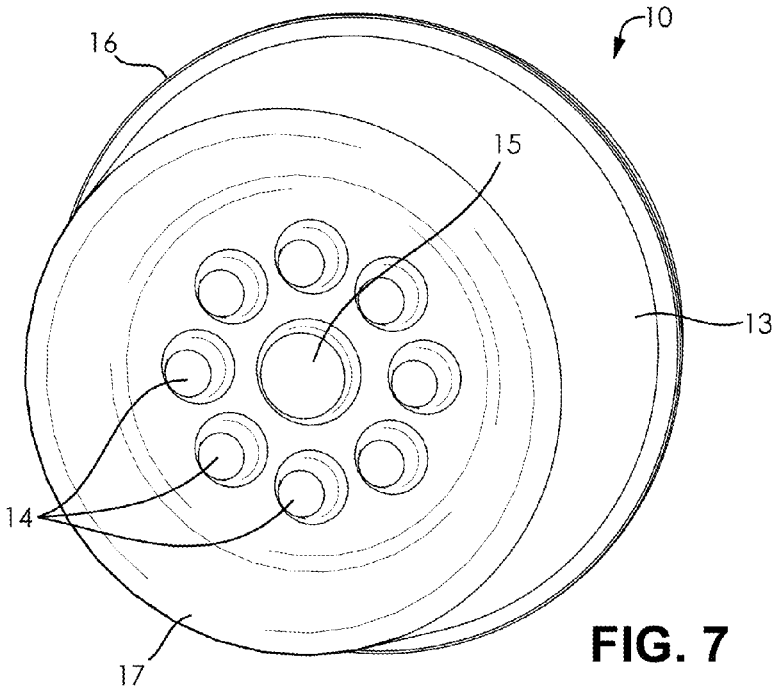
FIG. 7 is a rear perspective view of a hookah tobacco container in accordance with an embodiment of the present invention.
Figure 8:
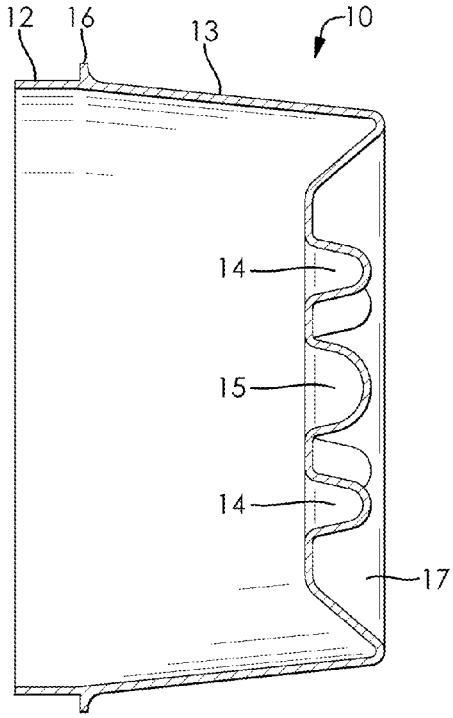
FIG. 8 is a cross-sectional view of a hookah tobacco container in accordance with an embodiment of the present invention.

Turning now to FIGS. 1-8, views of a hookah tobacco container, in accordance with an embodiment of the present invention, are shown. In these views, an embodiment of the present invention is shown with a container body 10 with a cylindrical walled area 12 and a bottom portion 13. The bottom portion 13 is constructed with multiple liquid retention areas of varying sizes. In the embodiment shown, numerous smaller liquid retention areas 14 and shown surrounding a larger liquid retention area 15. Also shown in these views is a top lip 16 that is configured to receive a top and allow for the hookah tobacco container to be sealed from external elements, allowing for safe storage for extended durations.

While optional, also shown in FIGS. 1-8 is a cylindrical liquid retention means 17 that is comprised of a channel that runs around the outside bottom portion of the hookah tobacco container. While the embodiments shown in FIGS. 1-8 utilize numerous liquid retention means, one of ordinary skill in the art would appreciate that a hookah tobacco container could be comprised of fewer or only one time of liquid retention means, and embodiments of the present invention are contemplated for use with any number and type of liquid retention means.

It should be noted that the features illustrated in the drawings are not necessarily drawn to scale, and features of one embodiment may be employed with other embodiments as the skilled artisan would recognize, even if not explicitly stated herein. Descriptions of well-known components and processing techniques may be omitted so as to not unnecessarily obscure the embodiments.

While multiple embodiments are disclosed, still other embodiments of the present invention will become apparent to those skilled in the art from this detailed description. The invention is capable of myriad modifications in various obvious aspects, all without departing from the spirit and scope of the present invention. Accordingly, the drawings and descriptions are to be regarded as illustrative in nature and not restrictive.

The invention claimed is:

1. A tobacco container comprising:

a container body comprising a walled area and a bottom portion connected in a manner forming a hollow cavity for the receipt of tobacco, wherein said bottom portion comprises one or more liquid retention areas, wherein said one or more liquid retention areas are formed as one or more depressions in said bottom portion of said container body that are configured to store liquids; and a filtering means, wherein said filtering means is adapted to provide a porous barrier that prevents tobacco from entering said one or more liquid retention areas.

2. The tobacco container of claim 1, wherein said filtering means comprises a porous filter.

3. The tobacco container of claim l, wherein said filtering means comprises a screen.

4. The tobacco container of claim 1, further comprising a top.

5. The tobacco container of claim 4, wherein said top is configured to be received upon the container body such that the hollow cavity is sealed.

6. The tobacco container of claim 1, wherein said one or more depressions are generally circular depressions in the bottom portion.

7. The tobacco container of claim 1, wherein said one or more liquid retention areas further provide stabilization for the tobacco container.

8. The tobacco container of claim 1, wherein said filtering means rests on top of said bottom portion of said container body such that liquid may drain from tobacco placed in said container body into said one or more liquid retention areas for storage.

9. The tobacco container of claim 8, wherein said filtering means and said one or more liquid retention areas allow for tobacco and liquids to be separately stored to prevent spoilage of the tobacco.

10. The tobacco container of claim 8, wherein said filtering means allows for the liquid stored in said one or more liquid retention areas to be reapplied to the tobacco by agitating said tobacco container.

11. A tobacco container comprising:

a container body comprising a walled area and a bottom portion connected in a manner forming a hollow cavity for the receipt of tobacco, wherein said bottom portion comprises one or more liquid retention areas which comprise means adapted to collect and store liquid away from tobacco that is placed in said container body to prevent the liquid from causing the tobacco to spoil during storage, wherein said one or more liquid retention areas are configured to allow the liquid stored in said one or more liquid retention areas to be reapplied to the tobacco by agitating said tobacco container.

12. The tobacco container of 11, comprising a filtering means adapted to provide a porous barrier that prevents the tobacco from entering said one or more liquid retention areas.

13. The tobacco container of claim 12, wherein said filtering means is configured to facilitate the drainage of liquid away from the tobacco that is placed in said container body to said one or more liquid retention areas.

14. The tobacco container of claim 12, wherein said filtering means is configured to allow the liquid that has been collected in said one or more liquid retention areas to be reapplied to the tobacco by agitating said tobacco container.

15. The tobacco container of claim 11, wherein said one or more liquid retention areas are selected from a group of liquid retention areas comprising a sloping edge trough and one or more teardrop shaped depressions in the bottom portion of said container body.

16. The tobacco container of claim 11, further comprising a top.

17. The tobacco container of claim 16, wherein said top is configured to be received upon the container body such that the hollow cavity is sealed.

* * * * *